US008715036B2

(12) United States Patent
Junker

(10) Patent No.: US 8,715,036 B2
(45) **Date of Patent: *May 6, 2014**

(54) GRINDING CENTER AND METHOD FOR THE SIMULTANEOUS GRINDING OF MULTIPLE CRANKSHAFT BEARINGS

(75) Inventor: Erwin Junker, Buehl/Baden (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 1058 days.

This patent is subject to a terminal disclaimer.

(21) Appl. No.: 12/663,675

(22) PCT Filed: May 20, 2008

(86) PCT No.: PCT/EP2008/056186

§ 371 (c)(1),
(2), (4) Date: Jan. 14, 2010

(87) PCT Pub. No.: WO2008/148638

PCT Pub. Date: Dec. 11, 2008

(65) Prior Publication Data

US 2010/0173565 A1 Jul. 8, 2010

(30) Foreign Application Priority Data

Jun. 8, 2007 (DE) ..... 10 2007 026 562

(51) Int. Cl.
*B24B 5/42* (2006.01)

(52) U.S. Cl.
USPC ..... 451/8; 451/49; 451/249

(58) Field of Classification Search
USPC ..... 451/49, 5, 8, 249, 246, 242
See application file for complete search history.

(56) References Cited

U.S. PATENT DOCUMENTS

| | | | | |
|---|---|---|---|---|
| 2,054,364 | A * | 9/1936 | De Leeuw | 451/251 |
| 2,232,228 | A * | 2/1941 | Groene | 451/251 |
| 5,997,452 | A | 12/1999 | Assie | |
| 6,102,838 | A | 8/2000 | Assie | |
| 6,334,806 | B1 * | 1/2002 | Sano et al. | 451/5 |
| 6,419,563 | B1 * | 7/2002 | Ido et al. | 451/57 |
| 6,913,522 | B2 | 7/2005 | Junker | |

FOREIGN PATENT DOCUMENTS

| | | |
|---|---|---|
| DE | 198 59 360 | 7/2000 |
| DE | 695 18 856 | 4/2001 |
| DE | 101 44 644 | 4/2003 |
| DE | 103 04 252 | 8/2004 |
| EP | 1 044 764 | 10/2000 |
| EP | 1 088 621 | 4/2001 |
| WO | WO-2005/000507 | 1/2005 |

* cited by examiner

*Primary Examiner* — Robert Rose
(74) *Attorney, Agent, or Firm* — Jordan and Hamburg LLP

(57) ABSTRACT

The invention relates to a grinding center for the simultaneous grinding of multiple main bearings and rod bearings and/or central sections of crankshafts (22). Two rod bearing grinding spindles (14, 15), wherein the first can be displaced only in the Z direction and the second can be minimally displaced only in the X direction, are mounted on a common rod bearing cross-slide (11). In the final phase of the grinding, a correction of dimension deviation between the two machined rod bearings is carried out via a separate control of the second rod bearing grinding spindle (15), as a dimension or roundness correction. The deviations are detected by measuring devices.

18 Claims, 7 Drawing Sheets

GRINDING CENTER AND METHOD FOR THE SIMULTANEOUS GRINDING OF MULTIPLE CRANKSHAFT BEARINGS

The invention relates to a grinding center for grinding crankshafts having main and rod bearings, wherein a plurality of main and rod bearings are ground simultaneously.

Grinding centers of this type are used for the rough-grinding and/or precision-grinding of crankshafts in high piece numbers. The crankshafts involved are frequently for four-cylinder in-line engines in the automobile industry, in which two rod bearings are in each case arranged in the same angular position with respect to the longitudinal axis of the crankshaft. Said two rod bearings are ground simultaneously (at the same time) to increase productivity. An example of such a procedure is described in EP 1 044 764 A2 and EP 1 088 621 B1.

For the main bearings of crankshafts, the simultaneous grinding of a plurality of bearings has already been known for a relatively long time, for example from U.S. Pat. No. 3,487,588. In this case, the grinding spindle for the main bearings has a number of grinding wheels equal to the number of main bearings. The grinding wheels are located on a common axis. A more recent disclosure in this regard is found in DE 101 44 644 B4.

In the case of the grinding center for crankshafts according to EP 1 044 764 A2, for the simultaneous grinding of two rod bearings of a crankshaft, use is made of a rough-grinding wheel and a finish-grinding wheel which are each mounted fixedly on a dedicated cross slide via the associated grinding spindle. The two cross slides are movable independently of each other in the longitudinal direction (Z direction) of the crankshaft and are advanceable in the direction of the crankshaft (X direction). Via a corresponding control of the cross slides and grinding spindles, simultaneous machining of two rod bearings in one clamping set-up is possible, wherein the one rod bearing is rough-ground and the other is finish-ground. In this case, the grinding operation is monitored continuously via associated measuring devices.

EP 1 088 621 B1 describes a method and an apparatus for the simultaneous grinding of at least two bearings of a crankshaft, in which there is substantial structural and operational overlap with the grinding center shown in EP 1 044 764 A2. A common feature of both systems is that they each use a dedicated cross slide for each of the two grinding spindles used. Each of said cross slides has to be activated separately for the entire grinding operation and constantly monitored and corrected in accordance with real time data, which is determined via measuring heads, regarding the roundness and the dimensions of the ground bearing. The construction of the grinding center with two separate cross slides—just for the machining of two bearings—requires a large amount of space and a considerable outlay on components and associated control systems.

Proceeding from said prior art, it is the object of the invention to indicate a grinding center for the grinding of crankshafts, in which the structural outlay and space required are substantially reduced and with which the simultaneous high-quality grinding of main bearings and rod bearings is possible in a particularly rapid and economical manner.

This object is achieved by a grinding center having the features according to claim 1.

In the case of the grinding center according to the invention, the space required and the structural outlay are advantageously already reduced by the fact that two stations for the simultaneous (isochronous) grinding of at least two bearings are combined to form a grinding center. In the first station, together with the main bearings, centrally encircling parts of the journal-side and flange-side crankshaft end can also be ground, to be precise on the (planar) face side and/or in diameter. Since all of the main bearings can be ground simultaneously in the first station, there is, in contrast to the second station, a spare amount of time which can be used.

If the two stations are arranged in a common axial direction of the crankshafts to be ground, the moving of the crankshafts from the one station into the other also proves to be very simple. Furthermore, a number of advantages emerge from the arrangement of two grinding spindles for machining rod bearings on a common cross slide. Said additional advantages are considered in particular to be a simplification of the control of the grinding process and the reduction in the number of components and in the space required.

According to the invention, the joint grinding of two rod bearings is controlled in such a manner that the rate of advance and the monitoring/correction of the removal of material from and of the true running of the ground bearings initially take place only via the control of the movements of the common rod-bearing cross slide. In this phase, the main removal of material of the grinding of both rod bearings takes place. The first grinding spindle and the second grinding spindle are controlled differently in terms of movement only when the desired dimensions are approximately reached. The first rod-bearing grinding spindle, which is connected to the rod-bearing cross slide rigidly with respect to the advancing direction (X direction) of the grinding wheels, is furthermore controlled via the control system of the rod-bearing cross slide in accordance with dimensional and roundness values, which are determined via a measuring device, in such a manner that the required final desired values for the grinding operating in question are achieved.

The roundness values do not absolutely have to be measured for each rod bearing. After a measurement, said correction values can be recorded in the control system and stored for a certain number of crankshafts until a further measurement of roundness takes place.

Although the advancing of the second rod-bearing grinding spindle in this phase also follows the movement of the rod-bearing cross slide, a further movement component in the X direction is also superimposed on said movement. Said further movement component serves for a differential correction of dimensional and/or roundness deviations occurring at the two simultaneously machined rod bearings. Such deviations can be caused, for example, by means of different wear of the two grinding wheels. A further substantial reason for said deviation is that the shafts are distorted slightly during the grinding, since stresses may be released in the material. According to the invention, said deviations are detected by continuous determination of the dimensions and roundness of the two rod bearings, for which purpose corresponding measuring devices are provided for each rod bearing.

In the final grinding phase, the differences to be corrected between the two rod bearings are only small; experience has shown that they lie within the range of a hundredth or thousandth of a millimeter. Therefore, only a small adjustment range is needed for the movement of the second rod-bearing grinding spindle. Said range advantageously needs to comprise only approximately +/−0.2 mm.

According to claim 2, the two rod-bearing grinding spindles are adjustable relative to each other in the axial direction on the rod-bearing cross slide. This permits adaptation to different axial distances between the rod-bearing pairs to be ground, and also adjustment to different types of crankshaft. The axial adjustability is expediently incorporated into the control system of the machine and is automatically triggered. In general, the second rod-bearing grinding spindle which in any case is arranged adjustably in the radial direction is also designed to be axially adjustable, although the construction the other way round is also conceivable, in which the second rod-bearing grinding spindle is axially fixed on the rod-bearing cross slide while the first rod-bearing grinding spindle is used for the axial adjustment on the rod-bearing cross slide.

In an embodiment of the invention, a configuration of the drive for movement of the one (second) grinding spindle in the dimensional and roundness correction axis as an NC axis is preferred according to claim 3, since such an axis can easily be integrated into the CNC machine control system.

An advantage is also afforded in the case of a configuration of the grinding cell according to claim 4, in which the machining in the first station also includes grinding of the face sides of the crankshaft. By this means, the time $T_1$ can be used and adapted in such a manner that two pairs of rod bearings are machined in the corresponding time $T_2$.

The planar faces of the bearing points of the crankshafts can be ground either by the main-bearing cross slide being offset in the Z direction or by the main-bearing grinding wheels being offset axially on the main-bearing grinding spindle, cf. claims 5 and 6. However, it is also possible to offset the crankshaft in the axial direction in relation to the main-bearing grinding wheels, cf. claim 7.

If the machining times $T_1$ and $T_2$ for the main and rod bearings according to claim 6 are coordinated with each other, a particularly economical operation of the grinding center is produced, since the loading or unloading of the two stations can then be carried out simultaneously and therefore waiting times dispensed with.

According to claim 9, the pendulum stroke movement is preferably used for the grinding of the rod bearings, thus resulting in simplification for the crankshaft mounting and drive for machining of the rod bearings. In this connection, the main bearings which are ground in the first station can readily be used for the crankshaft mounting in the second station, thus enabling a high degree of accuracy in the machining of the rod bearings to be achieved. Furthermore, the arrangement according to the invention and the activation of the two rod-bearing grinding spindles on just one cross slide leads to there being only a single advancing slide. The main movement of the two grinding wheels, namely the pendulum stroke movement and the feed motion, are therefore brought about by a single advancing slide. This results in a substantial simplification of the control system in relation to the prior art, since only one advancing slide has to be monitored and controlled during the predominant part of the machining operation. The different control of the movement of the two grinding spindles in the final grinding phase ensures that any deviations between the two rod bearings are detected and compensated, such that at the end the two rod bearings have been ground to the desired dimensions.

The clamping and the rotational drive of the crankshafts via specially designed main-bearing and rod-bearing headstocks or corresponding tailstocks according to claim 10 permits a particularly flexible use of the grinding center. Clamping of the crankshaft with the option of rotation about the main-bearing longitudinal axis or about the rod-bearing longitudinal axis permits the choice between normal grinding or pendulum stroke grinding for the rod-bearing grinding.

A continuous measurement of the dimensions and of the roundness of the bearings in the machining operation according to claim 11 permits a near-instantaneous detection and highly accurate correction of the grinding result.

Of course, with a grinding center according to the invention, in addition to four-cylinder crankshafts, other crankshafts can also be ground if they have two rod bearings each fitted in the same angular position on the crankshaft. Therefore, the machining of camshafts is also possible if the latter have at least two main bearings and two cams each arranged in the same angular position.

The invention also relates to a method for grinding the main and rod bearings and/or central parts of crankshafts according to claim 12. Refinements of said method are described in the dependent claims.

The grinding center and the method according to the invention are explained in more detail below with reference to the exemplary embodiments which are illustrated in the drawings, in which.

Figure 1:
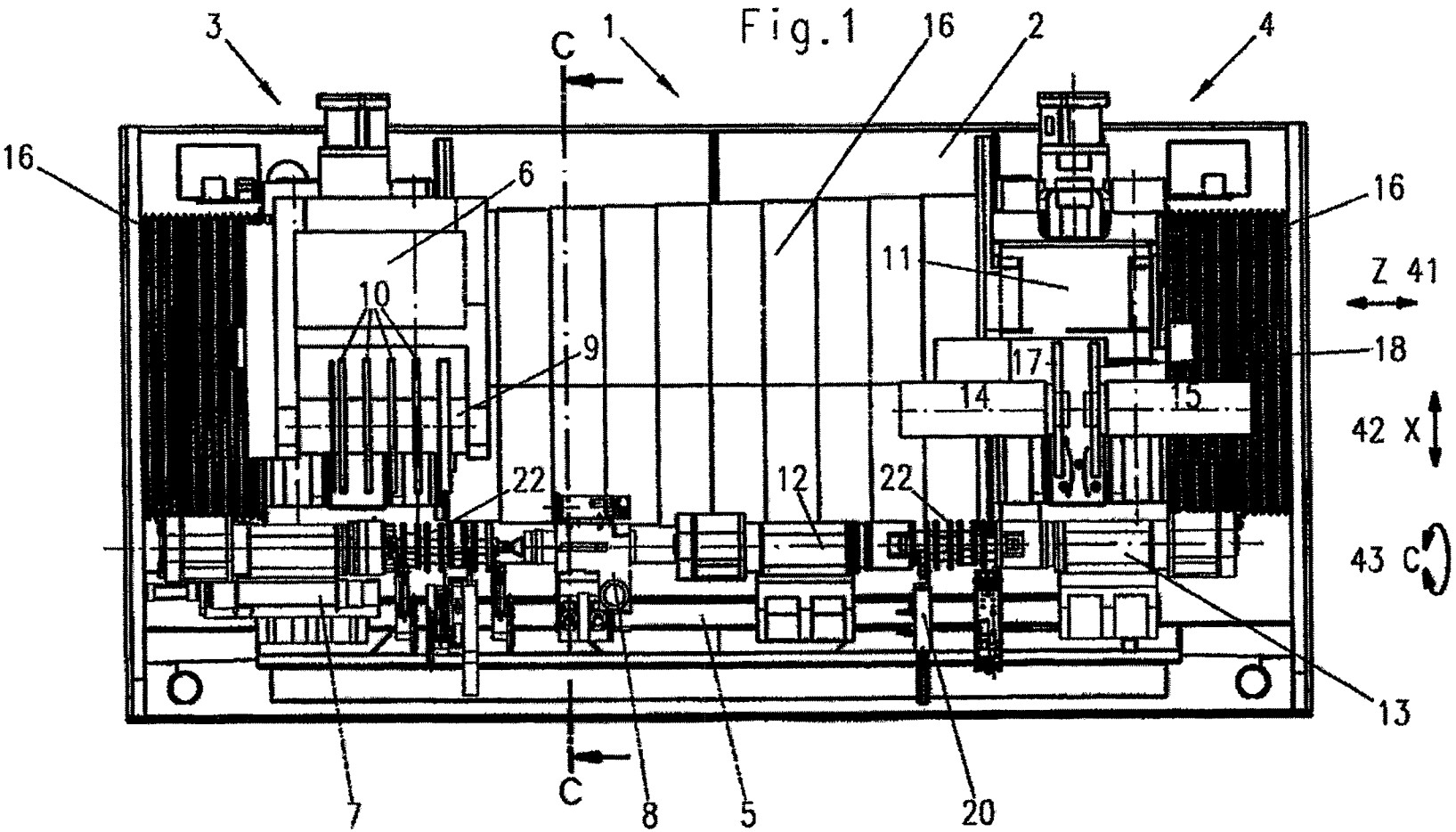
FIG. 1 shows a schematic top view of a grinding center, which is designed as a grinding cell, according to the invention.

FIG. 1 illustrates a grinding center, which is designed as a grinding cell 1, in top view. Said grinding cell has a common machine bed 2 on which two stations 3, 4 for machining crankshafts 22 by grinding are arranged. The stations 3, 4 have a common grinding table 5 on which there are in each case holding devices and drives for the crankshafts 22. The grinding cell customarily also has a machine hood and loading and unloading devices for supplying and removing the crankshafts 22 and for the transportation thereof from the first station 3 into the second station 4. However, these are not shown in FIG. 1, and therefore neither is the CNC control device with input keyboard nor hydraulic and/or pneumatic supply devices.

Figure 2:
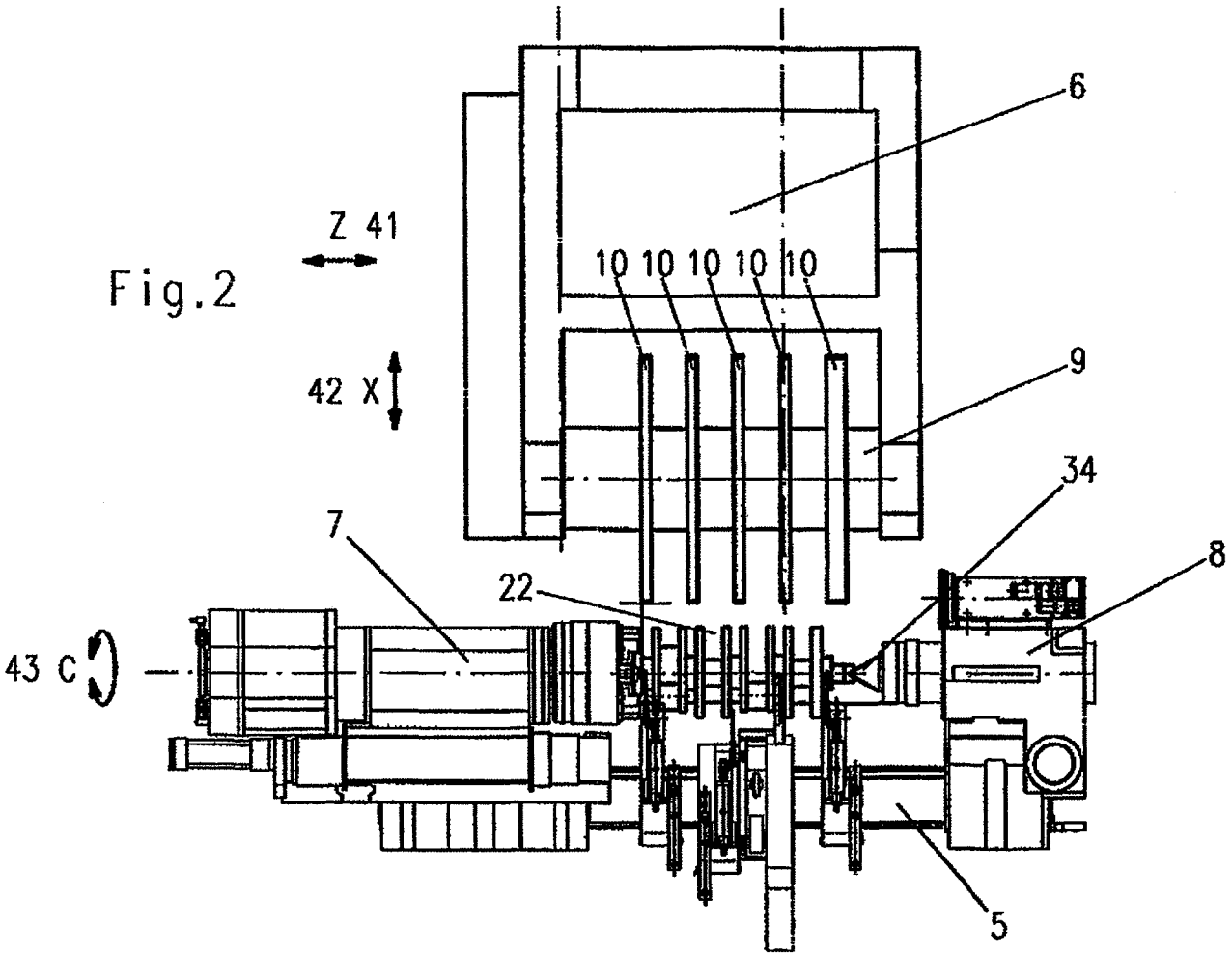
FIG. 2 shows a schematic top view of the first station of the grinding cell, said station serving to machine the main bearings of a crankshaft.
Figure 4:
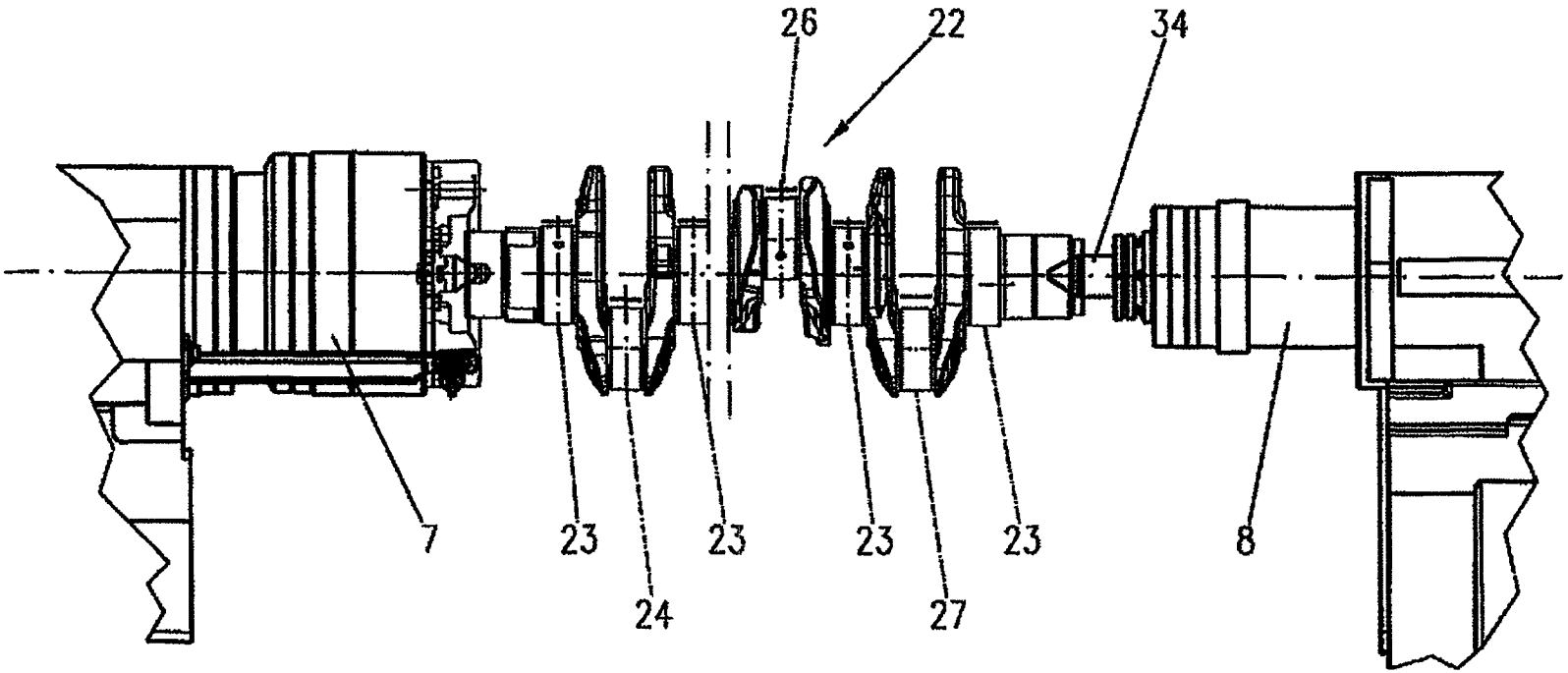
FIG. 4 shows the clamping of the crankshaft in the first station of the grinding cell.

The first station 3 of the grinding cell 1, which station is illustrated individually in FIG. 2, serves to grind the main bearings 23 of the crankshafts 22. For illustrative reasons, the most important functional parts of the first station 3 are therefore provided with the additional designation "main-bearing". The main bearings 23 (FIG. 4) are ground by means of a plurality of main-bearing grinding wheels 10 which are arranged on a main-bearing grinding spindle 9. The main-bearing grinding spindle 9, for its part, is fastened to a main-bearing cross slide 6 which is movable under CNC control in the Z direction, which corresponds to the crankshaft longitudinal axis 29, and in the X direction, which permits advancement in a direction perpendicular to the crankshaft longitudinal axis 29. Guide tracks or sliding rails on which the main-bearing cross slide 6 is moved in the Z direction cannot be seen because they are covered by coverings 16. The crankshaft 22 to be machined is clamped between a main-bearing workpiece headstock 7 and a main-bearing footstock 8, as illustrated more clearly in FIG. 4, and, according to the illustration from FIG. 2, is set into rotation by the main-bearing workpiece headstock 7. In the first station 3, at least two main bearings 23 of the crankshaft 22 are rough- or finish-ground simultaneously, for which a time $T_1$ is required.

Figure 3:
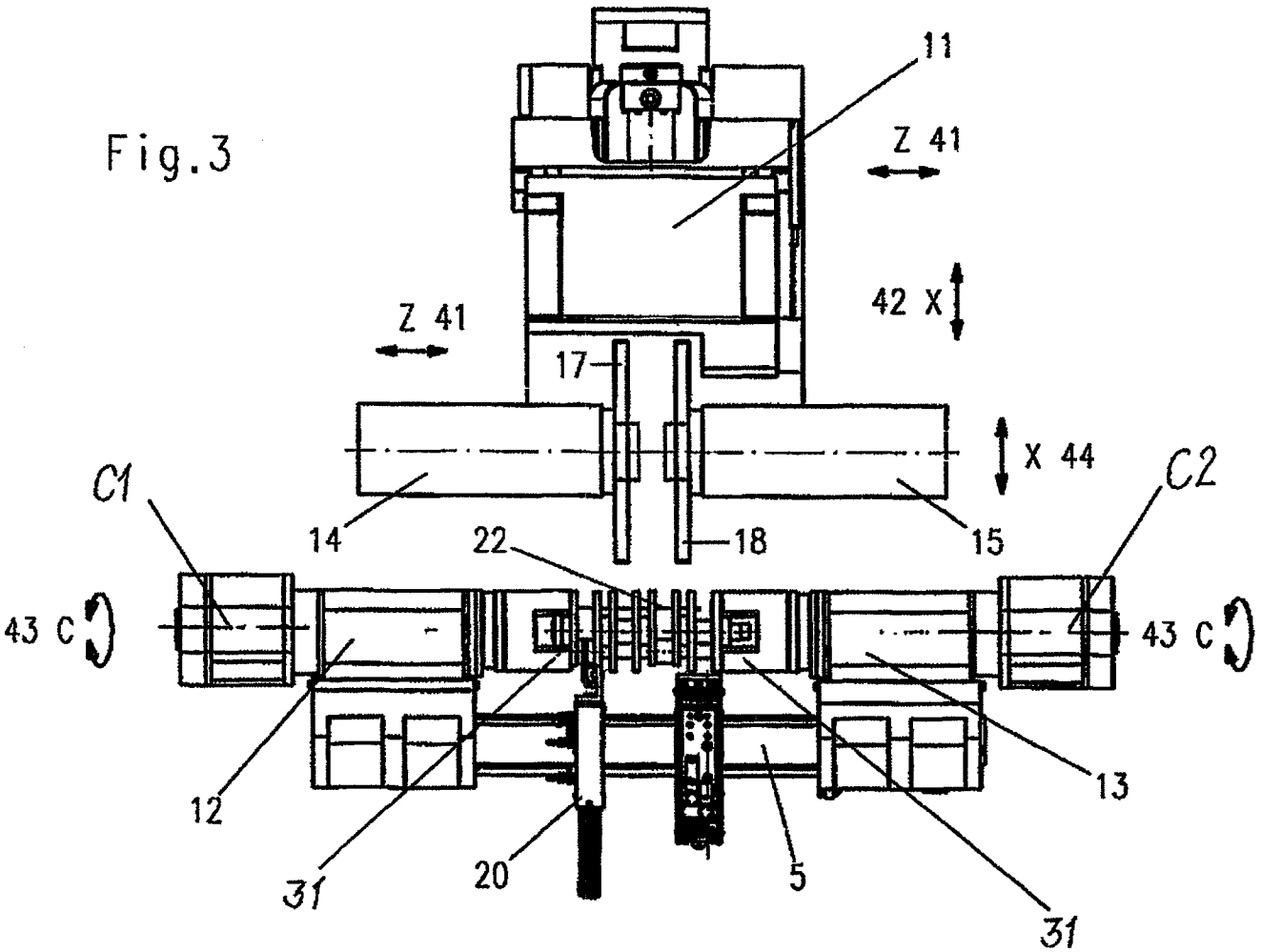
FIG. 3 shows a schematic top view of the second station of the grinding cell, said station being used to machine the rod bearings.

The second station 4 of the grinding cell 1, which station is shown individually in FIG. 3, is used for machining the rod bearings 24 to 27 of the crankshaft 22, wherein in each case two rod bearings 24 to 27, which are in the same angular position with respect to the crankshaft longitudinal axis 29, are ground simultaneously. The time required for grinding all four rod bearings 24 to 27 is $T_2$. For illustrative reasons, the most important functional parts of the second station 4 are provided with the additional designation "rod-bearing".

The crankshaft 22 to be ground is also clamped centrally in the second station 4, i.e. the common longitudinal axis of the clamping devices on both sides is identical to the longitudinal axis 29 of the crankshaft 22, which longitudinal axis is defined by the main bearings 23 of the crankshaft. As can be seen from FIGS. 3 and 5, the crankshaft 22 is clamped in the second station 4 by way of the outer main bearings 23 of the crankshaft, which have been ground in the first station 3. By this means, an exact relationship of the rod bearings 24 to 27 to the main bearings 23 of the crankshaft 22 is established.

According to FIG. 3, a respective rod-bearing workpiece headstock 12, 13 is provided on both sides of the crankshaft 22 for clamping purposes. The chucks 31 of said rod-bearing workpiece headstocks 12, 13 are provided with supporting shells 32 (cf. FIG. 5) and are driven by respective C1 and C2 axes which rotate absolutely synchronously. However, in the second station 4, the crankshaft 22 can also be accommodated between toes and is then driven, at least only on one side, by a rod-bearing workpiece headstock 12, the chuck of which is provided with clamping jaws 33 mounted in a floating manner, and brings about a compensating, radially play-free rotary drive. The crankshaft 22 is then aligned by the center thereof on the center points.

The shape of the receptacle of the crankshaft 22 in the second station 4 can be varied and optimized in accordance with the specific individual case.

In both stations 3 and 4, the crankshaft 22 can be supported by one or more self-centering steady rests.

Figure 6:
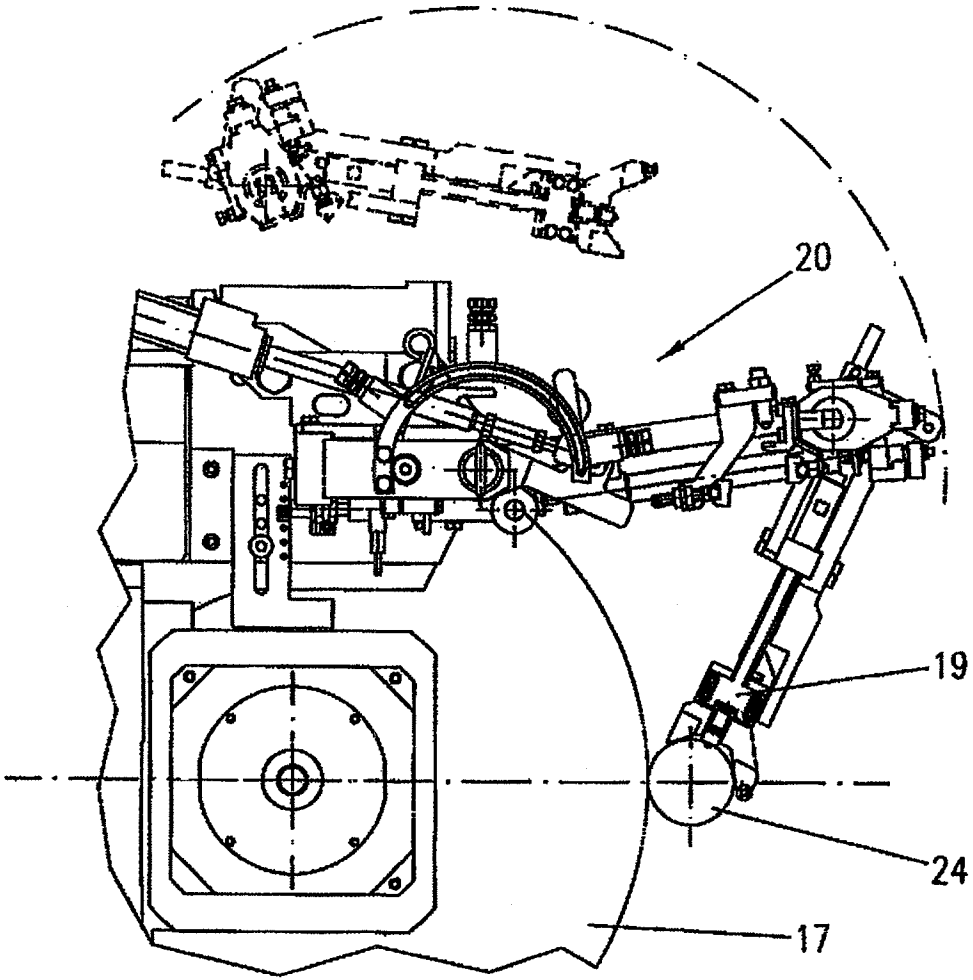
FIG. 6 shows the arrangement in the second station of a measuring device for the dimensions and the roundness of a bearing to be machined.

A rod-bearing cross slide 11 which is movable in the direction of the axes Z2 and X2 which are perpendicular to each other, i.e. is movable parallel to the crankshaft longitudinal axis 29 and perpendicularly thereto, is provided in the second station. The rod-bearing cross slide 11 supports a first rod-bearing grinding spindle 14 and a second rod-bearing grinding spindle 15. Of said grinding spindles, the first rod-bearing grinding spindle 14 is connected fixedly to the rod-bearing cross slide 11 in the direction perpendicular to the crankshaft longitudinal axis 29. By contrast, the second rod-bearing grinding spindle 15 is arranged movably on the rod-bearing cross slide 11 in the direction perpendicular to the crankshaft longitudinal axis 29. The movement of said second rod-bearing grinding spindle is controlled in accordance with a dimensional or roundness error which is obtained from an in-process measurement during the grinding operation. For this purpose, the diameters of the rod bearings 24, 27 and 25, 26 which are to be ground in pairs are measured continuously during the grinding operation by in-process measuring heads 19 of a measuring device 20 (FIG. 6).

Each of the two rod-bearing grinding spindles 14, 15 bears a rod-bearing grinding wheel 17, 18, the axial distance of which from each other has to correspond to the distance between the rod bearings 24 to 27 to be ground in pairs. For this purpose, the two rod-bearing grinding spindles 14, 15 have to be movable in relation to each other in their axial direction, i.e. in the direction of the axis of rotation of their rod-bearing grinding wheels 17, 18, on the rod-bearing cross slide 11. The axial distance between the rod-bearing grinding spindles and grinding wheels has to be adjusted each time a different type of crankshaft is to be ground or, in the case of a specific crankshaft, a pair of rod bearings with a changed distance is to be ground. Insofar as this is concerned, the change in the distance has to be incorporated into the entire control system of the grinding operation. In this case, the first rod-bearing grinding spindle 14 or the second rod-bearing grinding spindle 15 can be arranged adjustably in the direction of its longitudinal axis on the rod-bearing cross slide 11.

Figure 5:
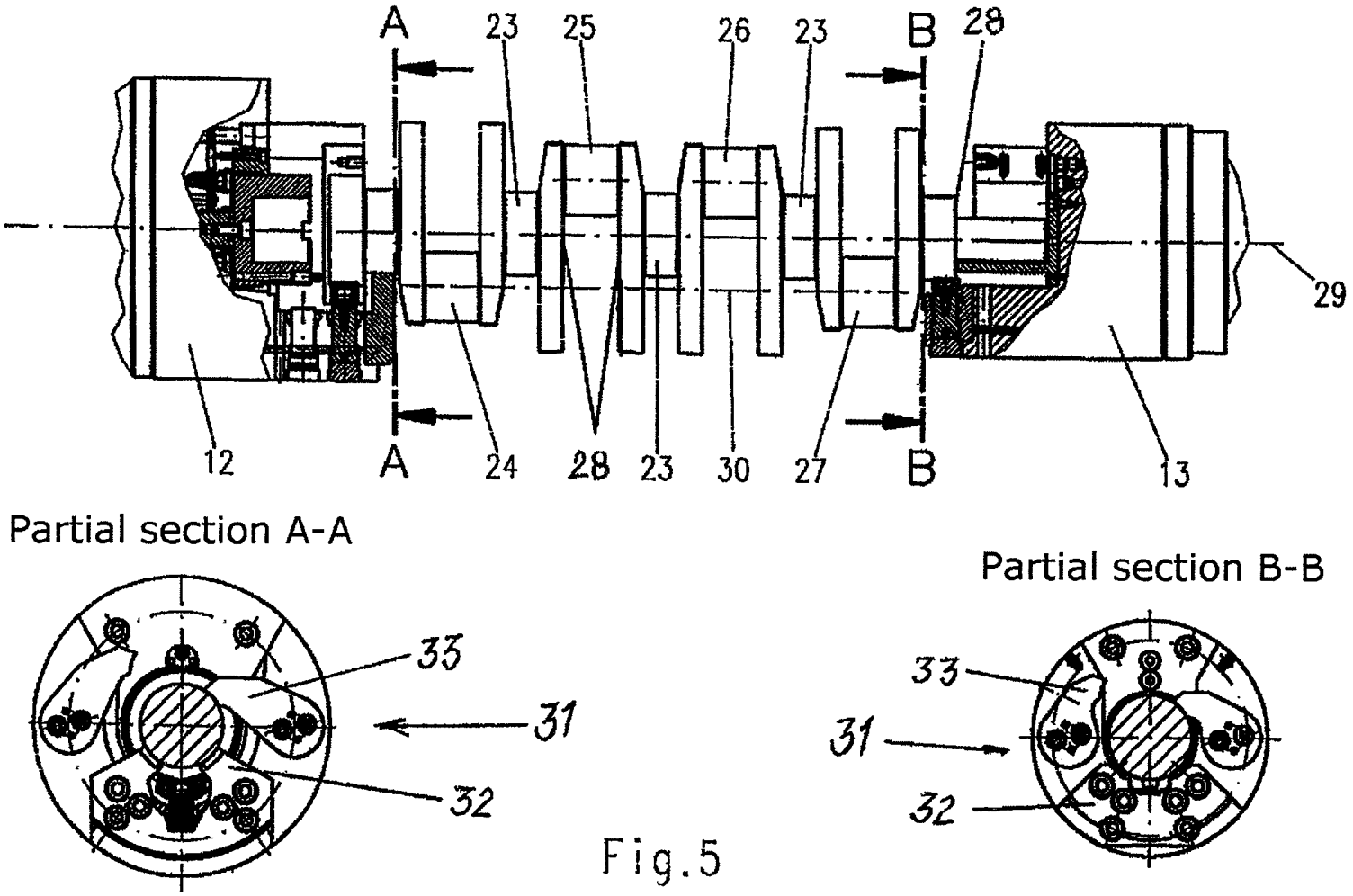
FIG. 5 shows details of the clamping of the crankshaft in the second station of the grinding cell.

A particular characteristic of crankshafts 22 for four-cylinder in-line engines can be seen particularly clearly from FIG. 5: the two outer rod bearings 24 and 27 have a common angular position with respect to the axis of rotation and longitudinal axis 29 of the crankshaft 22, as do the two inner rod bearings 25 and 26, the angular position of the two rod-bearing pairs 24 and 27, and 25 and 26 differing.

This characteristic is used for the economical operation of the grinding center according to the invention. This is because, with the two rod-bearing grinding wheels 17 and 18, the two rod bearings 24, 27 and 25, 26 are each simultaneously ground per se, wherein the word "simultaneously" also stands for the expressions "at the same time" or "isochronously" which can be encountered in grinding technology. It is therefore meant in each case that the grinding operation proceeds approximately at the same time, but not that it has to be ended exactly at the same time. The second rod bearing is more frequently finish-ground only after the first one since, for example, a residual oversize of 0.02 mm still has to be removed.

FIG. 6 shows the arrangement of a measuring device 20 for the continuous measurement of the roundness and the dimensions of a rod bearing in the second station 4 by means of a measuring head 19. During the grinding operation, the measuring head 19 comes into contact with the rod bearing 24-27 to be monitored, and continuously produces signals regarding the dimensions and/or the roundness of the rod bearing 24-27, which signals are evaluated by the CNC control system and are used for generating control commands for the drives of the rod-bearing cross slide 11 and/or the dimensional or roundness correction axis 44. The position of the measuring device 20 that is illustrated by broken lines in FIG. 6 corresponds to a retracted position which the measuring device 20 takes up, for example, during a planing operation and/or during the parts handling by the rod-bearing grinding wheels 17, 18.

Figure 7:
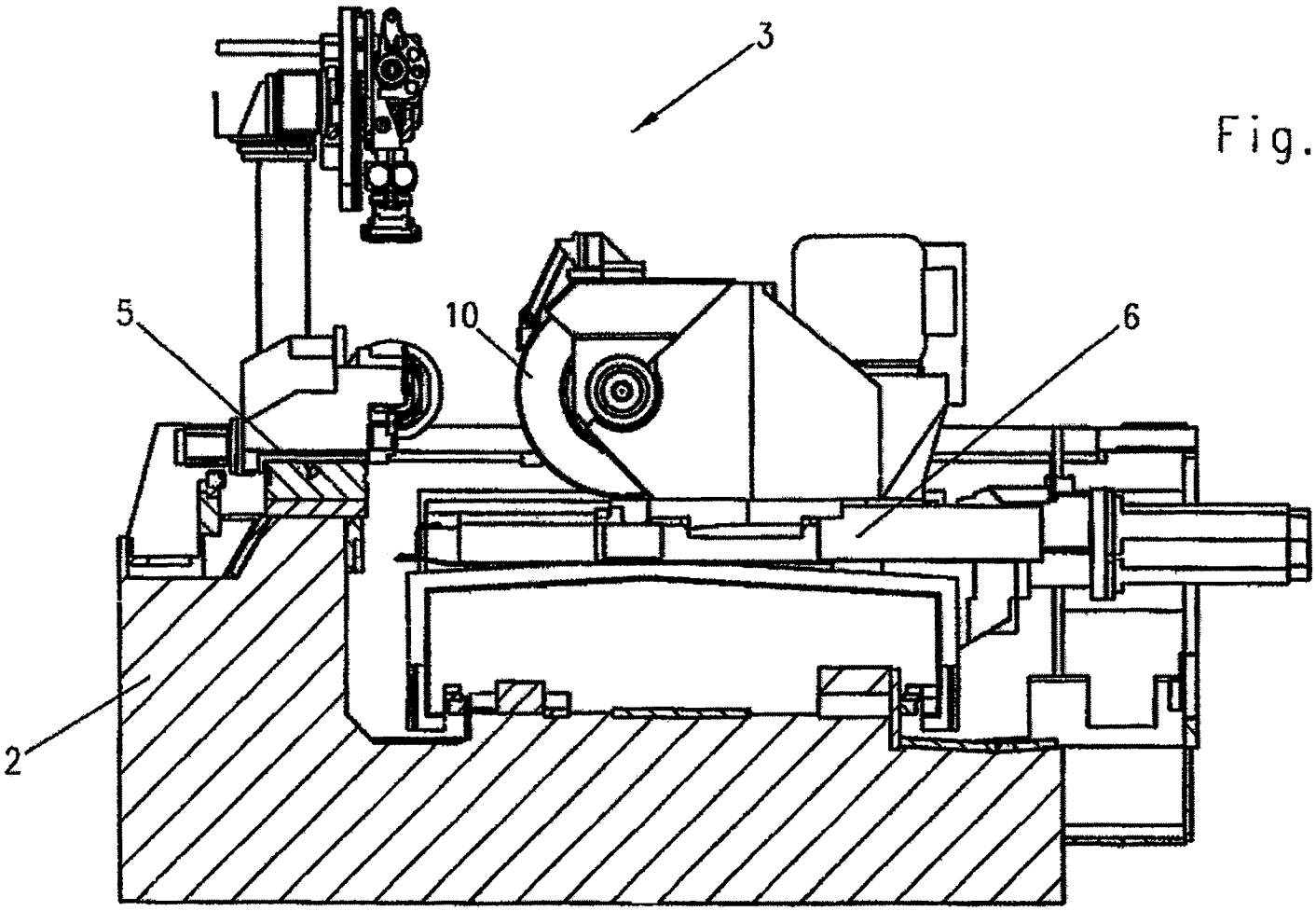
FIG. 7 shows a section through a grinding cell according to the invention in accordance with the section C-C in FIG. 1.

FIG. 7 illustrates a schematic side view of the first station 3 of the grinding cell 1 according to the section C-C in FIG. 1.

At the beginning of the rod-bearing grinding in the second station 4, the mutual axial distance between the two rod-bearing grinding wheels 17, 18 is adjusted, for example, to the distance between the rod bearings 24 and 27. The grinding of said rod bearings 24, 27 then begins in the CNC-controlled pendulum stoke movement. For this purpose, the two rod-bearing grinding spindles 14, 15 are first of all moved together perpendicular to the crankshaft longitudinal axis 29; in the process, the second rod-bearing grinding spindle 15 remains immovable in relation to the rod-bearing cross slide 11. This applies to the coarse-grinding or rough-grinding phase. However, the diameter precisely reached on each of the rod bearings 24, 27 during the grinding operation is measured and the roundness determined. As the finished dimensions are approached in the precision-grinding phase, the movement of the second grinding spindle 15 is decoupled from that of the rod-bearing cross slide 11. The rod-bearing cross slide 11 is moved in the direction of a dimensional or roundness correction axis 44 in accordance with the measurement at the rod bearing 24, and the final dimensions and the required roundness of the rod bearing 24 are finally achieved by means of the first rod-bearing grinding spindle 14. The second rod-bearing grinding spindle 27 simultaneously executes correction movements in relation to the rod-bearing cross slide 11 in accordance with the separate measurement at the rod bearing 27 if the measurements at the rod bearing 27 deviate from those of the rod bearing 24. Said deviations emerge from the continuous measurement at both rod bearings 24 and 27. The computer of the machine control system analyzes the measuring results and forms corresponding correction and control signals for the drive of the second rod-bearing grinding spindle 15.

Of course, the second rod-bearing grinding spindle 15 needs to be movable in relation to the rod-bearing cross slide 11 only to a small extent in the direction of the X axis. An adjustment distance which is advantageous in practice can be, for example, in the range of +/−0.2 mm. The grinding center can be adjusted in such a manner that the grinding time $T_1$ is equal to the grinding time $T_2$. Two of the main bearings 23 are then ground at approximately the same time as one pair 24, 27 or 25, 26 of the rod bearings.

The rod-bearing cross slide 11 is subsequently moved back, the distance of the two rod-bearing grinding spindles 14, 15 from each other is adjusted to the distance of the central rod bearings 25, 26 and the grinding cycle begins again.

LIST OF REFERENCE NUMBERS

1 Grinding cell
2 Machine bed
3 First station
4 Second station
5 Grinding table
6 Main-bearing cross slide
7 Main-bearing workpiece headstock
8 Main-bearing footstock
9 Main-bearing grinding spindle
10 Main-bearing grinding w heels
11 Rod-bearing cross slide
12 Rod-bearing workpiece headstock
13 Rod-bearing workpiece headstock
14 First rod-bearing grinding spindle
15 Second rod-bearing grinding spindle
16 Cover
17 First rod-bearing grinding wheel
18 Second rod-bearing grinding wheel
19 Measuring head
20 Measuring device
22 Crankshaft
23 Main bearing
24 Rod bearing
25 Rod bearing
26 Rod bearing
27 Rod bearing
28 Planar face
29 Main-bearing longitudinal axis
30 Rod-bearing longitudinal axis
31 Chuck
32 Supporting shells
33 Clamping jaws
34 (Center) points
41 Z axis
42 X axis
43 Axis of rotation
44 Dimensional and roundness correction axis

The invention claimed is:

1. A grinding center for simultaneously grinding main bearings and rod bearings of crankshafts, said grinding center having a first station in which a number of main-bearing grinding wheels is arranged axially on a main-bearing grinding spindle, which is arranged on a main-bearing cross slide, in such a manner that a number of main bearings corresponding to the number of main-bearing grinding wheels is ground at the same time in a time $T_1$, and having a second station in which two rod-bearing grinding wheels at the same time grind two rod bearings of the crankshaft in a time $T_2$ at the same time to $T_1$ and are mounted by their respective rod-bearing grinding spindle on a rod-bearing cross slide in such a manner that a first rod-bearing grinding spindle in the infeed direction is arranged in a positionally fixed manner on the rod-bearing cross slide and a second rod-bearing grinding spindle in the infeed direction is slightly adjustable relative to the first rod-bearing grinding spindle only in the direction of a dimensional or roundness correction axis.

2. The grinding center as claimed in claim 1, in which the two rod-bearing grinding spindles located on the rod-bearing cross slide are adjustable in relation to each other in the axial direction.

3. The grinding center as claimed in claim 1, in which the drive of the second rod-bearing grinding spindle of the second station is configured in such a manner that the second rod-bearing grinding spindle can be advanced to the crankshaft independently of the movement of the rod-bearing cross slide by means of an NC axis, which is effective within narrow limits, for either one or both of a dimensional correction or a roundness correction.

4. The grinding center as claimed in claim 1, with a configuration such that the main-bearing grinding wheels of the main-bearing grinding spindle of the first station are advanced radially for the grinding of the main bearings and are offset axially for the grinding of the face sides of the crankshaft.

5. The grinding center as claimed in claim 4, in which the main-bearing grinding wheels are offset axially by means of the main-bearing cross slide.

6. The grinding center as claimed in claim 4, in which the main-bearing grinding wheels are offset axially by the main-bearing grinding wheels being arranged in an axially offset-table manner on the main-bearing grinding spindle.

7. The grinding center as claimed in claim 1, with a configuration such that the crankshaft is offset axially in the longitudinal direction of the crankshaft for the grinding of the face sides thereof by means of the main-bearing grinding wheels.

8. The grinding center as claimed in claim 1, in which $T_1$ approximately corresponds to $T_2$.

9. The grinding center as claimed in claim 1, in which the rod-bearing cross slide is designed in such a manner that a pendulum stroke movement of the rod-bearing grinding wheels can be produced.

10. The grinding center as claimed in claim 1, in which the first and the second station each have a work headstock and a footstock, and the respective work headstocks and footstocks of the first and second station are designed in such a manner that the crankshaft having a main-bearing longitudinal axis and at least one rod-bearing longitudinal axis rotates centrally about the main-bearing longitudinal axis during operation.

11. The grinding center as claimed in claim 1, in which a measuring device is provided for the continuous dimensional and roundness measuring and delivers a signal for controlling the movement of the rod-bearing grinding spindle in the advancing axis or in the dimensional and roundness correction axis.

12. A method for simultaneously grinding the main bearings, rod bearings, and central parts of crankshafts in a grinding center having two stations, with the following method steps:

a. in the first station the main bearings of the crankshaft and central parts are ground with a set of main-bearing grinding wheels which are located on the common shaft of a main-bearing grinding spindle;

b. the crankshaft is brought into the second station;

c. in the second station two rod bearings having the same angular position with respect to the axis of rotation of the crankshaft are in each case ground isochronously by two rod-bearing grinding wheels at the same time as the main bearings in the first station;

d. the advancing movement of each of the two rod-bearing grinding wheels is individually computer-controlled, wherein the advancing movement of the second rod-bearing grinding wheel takes place only in accordance with a deviation from the advancing movement of the first rod-bearing grinding wheel;

e. in the grinding center two crankshafts are always machined simultaneously, wherein the grinding time $T_1$ in the first station is approximately equal to the grinding time $T_2$ in the second station.

13. The method as claimed in claim 12, in which the two rod-bearing grinding wheels are located on rod-bearing grinding spindles which are arranged on a rod-bearing cross slide, wherein the first rod-bearing grinding spindle with the first rod-bearing grinding wheel in the advancing direction is arranged in a positionally fixed manner on the rod-bearing cross slide and is advanced by the latter while the second rod-bearing grinding spindle with the second rod-bearing grinding wheel can be advanced to the crankshaft independently of the movement of the rod-bearing cross slide by means of an NC axis, which is effective within narrow limits, for either one or both of a dimensional correction or a roundness correction.

14. The method as claimed in claim 12, in which the main-bearing grinding wheels of the main-bearing grinding spindle are advanced radially for the grinding of the main bearings and are offset axially for the grinding of the face sides of the crankshaft.

15. The method as claimed in claim 14, in which the main-bearing grinding wheels (10) are offset axially by the main-bearing cross slide being offset axially.

16. The method as claimed in claim 14, in which the main-bearing grinding wheels are offset axially by being offset axially on the main-bearing grinding spindle.

17. The method as claimed in claim 12, in which the face sides of the crankshaft are ground by means of the main-bearing grinding wheels by the crankshaft being offset axially in this case.

18. A method for simultaneously grinding the main bearings and rod bearings in a grinding center having two stations, with the following method steps:

a. in the first station centrally encircling parts of the journal-side and flange-side end, together with the main bearings, are ground in diameter with a set of main-bearing grinding wheels which are located on the common shaft of a main-bearing grinding spindle;

b. the crankshaft is brought into the second station;

c. in the second station two rod bearings having the same angular position with respect to the axis of rotation of the crankshaft are in each case ground isochronously by two rod-bearing grinding wheels at the same time as the main bearings in the first station;

d. the advancing movement of each of the two rod-bearing grinding wheels is individually computer-controlled, wherein the advancing movement of the second rod-bearing grinding wheel takes place only in accordance with a deviation from the advancing movement of the first rod-bearing grinding wheel;

e. in the grinding center two crankshafts are always machined simultaneously, wherein the grinding time $T_1$ in the first station is approximately equal to the grinding time $T_2$ in the second station.

* * * * *